US011145430B2

(12) United States Patent
Campanella et al.

(10) Patent No.: US 11,145,430 B2
(45) Date of Patent: Oct. 12, 2021

(54) GAS TARGETING SYSTEM FOR PRODUCING RADIOISOTOPES

(71) Applicant: PMB, Peynier (FR)

(72) Inventors: Thomas Campanella, La Bouilladisse (FR); Alain Perez Delaume, Folcalqueiret (FR)

(73) Assignee: P M B, Peynier (FR)

( * ) Notice: Subject to any disclaimer, the term of this patent is extended or adjusted under 35 U.S.C. 154(b) by 199 days.

(21) Appl. No.: 16/472,267

(22) PCT Filed: Dec. 19, 2017

(86) PCT No.: PCT/FR2017/053679
§ 371 (c)(1),
(2) Date: Jun. 21, 2019

(87) PCT Pub. No.: WO2018/115705
PCT Pub. Date: Jun. 28, 2018

(65) Prior Publication Data

US 2019/0333654 A1 Oct. 31, 2019

(30) Foreign Application Priority Data

Dec. 22, 2016 (FR) ..... 1663237

(51) Int. Cl.
*G21K 5/08* (2006.01)
*G21G 1/10* (2006.01)
*H05H 6/00* (2006.01)

(52) U.S. Cl.
CPC ..... *G21K 5/08* (2013.01); *G21G 1/10* (2013.01); *H05H 6/00* (2013.01)

(58) Field of Classification Search
CPC ..... G21G 1/10; H05H 6/00; G21K 5/08
See application file for complete search history.

(56) References Cited

U.S. PATENT DOCUMENTS 5,764,715 A * 6/1998 Maenchen ..... G21G 1/10 250/492.3
5,917,874 A 6/1999 Schlyer et al.
(Continued)

OTHER PUBLICATIONS

Moon Byung Seok et al.: "Development of additive [11C]C02target system in the KOTRON-13 cyclotron and its application for [11C] radiopharmaceutical production", Nuclear Instrucments & Methods in Physics Research. Section B: Beam Interactions With Materials and Atoms, vol. 356, May 14, 2015 (May 14, 2015), pp. 1-7, XP029246388, ISSN: 0168-583X, D01: 10.1016/J.NIMB.2015.04.022 abstract; figures 2-5 p. 2, col. 2—p. 4, col. 1.
(Continued)

*Primary Examiner* — Sharon M Davis
(74) *Attorney, Agent, or Firm* — Nixon & Vanderhye

(57) ABSTRACT

Disclosed is a gas targeting system including a body, which has a frustoconical cavity; a cooling circuit including at least one channel which surrounds at least one portion of the cavity; a window, positioned facing an inlet of the cavity in order to close the cavity, including a fine sheet that is permeable to at least a portion of a beam of particles emitted by a particle accelerator and a support grid configured to support pressure differences between and inside of the cavity and an outside of the targeting system, with the fine sheet positioned between the support grid and the cavity; and a support flange which holds the window and is hermetically secured on the body, and which includes a mechanical attachment interface at the outlet of a particle accelerator.

19 Claims, 3 Drawing Sheets

(56) References Cited

U.S. PATENT DOCUMENTS

| | | | | |
|---|---|---|---|---|
| 2004/0000637 | A1* | 1/2004 | Wieland | G21G 1/10 250/284 |
| 2004/0100214 | A1* | 5/2004 | Erdman | G21G 1/10 315/500 |
| 2005/0061994 | A1* | 3/2005 | Amini | H05H 6/00 250/492.1 |
| 2009/0090875 | A1 | 4/2009 | Gelbart et al. | |
| 2009/0274259 | A1* | 11/2009 | Hur | H05H 6/00 376/194 |
| 2010/0086095 | A1* | 4/2010 | Ogasawara | G01T 1/00 376/202 |
| 2010/0294655 | A1 | 11/2010 | Hong et al. | |
| 2011/0280357 | A1* | 11/2011 | Stevenson | G21G 1/10 376/195 |

OTHER PUBLICATIONS

Min Goo Hur et al.: "Design and evaluation of a carbon-11 gas target having auxiliary cooling fins in the target cavity for the stable production of carbon-11", Nuclear Instruments & Methods in Physics Research. Section A: Accelerators, Spectrometers, Detectors, and Associated Equipment, vol. 655, No. 1, Jun. 17, 2011 (Jun. 17, 2011), pp. 108-110, XP028298440, ISSN: 0168-9002, D01: 10.1016/J.NIMA.2011.06.032 [retrieved on Jun. 17, 2011] abstract; figure 2a p. 2, col. 2.

* cited by examiner

GAS TARGETING SYSTEM FOR PRODUCING RADIOISOTOPES

BACKGROUND OF THE INVENTION

Field of the Invention

The present application concerns a target holder system for producing radioisotopes by irradiating a gaseous target fluid under pressure by a beam of charged particles, in particular a high energy beam, that is to say at 1 MeV at least.

Description of the Related Art

In nuclear medicine for example, positron emission tomography is an imaging technique requiring radioisotopes that emit positrons or molecules marked by those same radioisotopes.

To produce radioisotopes, a target holder system is installed at an exit of a particle accelerator.

A target holder system comprises for example one or more targets to irradiate. Each target comprises a radioisotope precursor which enables the corresponding radioisotope to be produced when the precursor has been irradiated. The target holder system is thus mounted at an exit of a particle accelerator with a target along an axis of the particle beam emitted by the accelerator. Thus the particle beam produced by the particle accelerator can irradiate the target of the target holder system to produce the radioisotope.

However, the target holder systems of the state of the art have various drawbacks.

SUMMARY OF THE INVENTION

The subject-matter of the present application is directed to providing an improved gas target holder system, moreover leading to other advantages.

To that end, according to a first aspect, there is provided a gas target holder system comprising:

a body, which comprises:

a cavity configured to contain a target gas to irradiate with a particle beam emitted by a particle accelerator, the cavity comprising at least one portion of frusto-conical shape, a back closing a wide base of the portion of frusto-conical shape and an opening, opposite the back relative to the portion of frusto-conical shape, forming an entry in order for at least part of the particle beam to enter the cavity;

a cooling circuit comprising at least one duct which comprises an inlet and an outlet and surrounds at least part of the cavity, the duct being positioned as close as possible to the parts heated by an interaction of the particle beam with the gas contained in the cavity, that is to say for example a surface of the cavity and the window mentioned below;

a window, positioned facing the entry of the cavity to close the cavity, permeable to protons to enable introduction into the cavity of protons of the particle beam emitted by the particle accelerator, the window comprising a thin sheet permeable to at least part of the particle beam emitted by the particle accelerator and a support grid configured to withstand pressure differences between an inside of the cavity and an outside of the target holder system, the thin sheet being positioned between the support grid and the cavity; and a support flange which holds the window and is hermetically secured on the body, and which comprises a mechanical fastening interface at an exit from a particle accelerator; the support flange being furthermore configured to hermetically close the cavity and to at least provide sealing between air outside the target holder system and a cooling fluid flowing in the cooling circuit, in addition to providing sealing between a vacuum formed in a beam line of the particle accelerator and a target gas under pressure contained in the cavity.

Such a target holder system for producing gaseous radioisotopes which comprises such a cavity which receives the target gas and which is sufficiently cooled thanks to such a cooling circuit, thus enables the required nuclear reactions between said target gas and the incident protons in a more compact volume.

In particular, the cooling circuit is for example unique for cooling both the cavity and at least the thin sheet of the window.

Such a gas target holder system for producing radioisotopes furthermore enables a greater stability of production of the radioisotopes and use at higher pressures than is usual, in particular thanks to the cooling circuit which has been improved.

A cavity length, that is to say a distance between the entry and the back of the cavity, may then be reduced, while having a "reversed cone" shape which takes into account phenomena of proton beam divergence when it enters into collision with the target gas.

This reduction in length nevertheless depends on the pressure difference. In an example embodiment, it is for example possible to double the pressure while reducing that length by half, that is to say that it changes for example from approximately 180 mm to approximately 90 mm.

The system thus has improved compactness relative to the systems of the prior art which enables an increase in the efficacy of the radiation protection equipment since it enables that equipment to be positioned as close as possible to the nuclear reaction zones and if need be to increase thicknesses of materials constituting that equipment for an identical external bulk.

In an example of implementation, the target holder system is a target holder system for producing $^{11}C$ radioisotopes by irradiating a target gas with a charged particle beam emitted by a particle accelerator.

Preferably, the cavity is configured to comprise a target gas under a pressure comprised between approximately 15 bars (1.5 MPa-megapascal) and approximately 50 bars (5 MPa), or even between approximately 20 bars (2 MPa) and approximately 50 bars, or even between approximately 40 bars (4 MPa) and approximately 50 bars.

A target gas pressure of at least 40 bars makes it possible for example to substantially reduce the depth of the cavity required to stop the particle beam.

In an example of implementation, the cavity comprises a target gas which comprises at least one $^{11}C$ (carbon 11) radioisotope precursor.

Preferably, the at least one $^{11}C$ radioisotope precursor comprises nitrogen gas ($^{14}N$).

According to a particularly convenient example, the window comprises a brazed assembly composed of the thin sheet positioned at an entry to the cavity, enabling the charged particles to enter the cavity, and of the support grid, which is perforated and which serves as a structural support for the thin sheet, configured to withstand a pressure difference created on opposite sides of the window during use of the system, that is to say between the vacuum of the particle accelerator and the pressure of the gas filling the cavity.

The support grid comprises for example equidistant perforations and/or openings of hexagonal shape, for example of honey-comb configuration.

The support grid for example has an open/filled area ratio comprised between approximately 70% and approximately 90%, preferably between approximately 72% and approximately 85%.

The support grid is for example of tungsten or of aluminum nitride.

The support grid is for example of thickness comprised between approximately 1 mm (millimeter) and approximately 3 mm.

The thin sheet is of small thickness, that is to say that it is of thickness equal to or less than 100 μm, or even 80 μm, or even 30 μm, or even 20 μm, for example according to the chosen material.

The thin sheet is for example of tungsten; it is then for example of thickness comprised between approximately 20 μm and approximately 30 μm.

According to another example, the thin sheet is of CVD synthetic diamond (CVD standing for "Chemical Vapor Deposition"), that is to say of synthetic diamond obtained by a Chemical Vapor Deposition method; it is then for example of thickness comprised between approximately 70 μm and approximately 80 μm.

For example, the cooling circuit duct is formed in a body wall.

In a preferred example embodiment, the cooling circuit duct comprises at least one helical portion which surrounds at least part of the cavity.

Moreover for example, the helical portion extends from the duct inlet, surrounds at least part of the cavity as far as the back of the cavity, then furthermore surrounds at least part of the cavity from the back as far as the duct outlet.

In one example embodiment, the body comprises a front surface which forms a bearing surface for at least part of the thin sheet of the window.

In a particular example, both the inlet and outlet of the duct emerge into the front surface of the body.

In an advantageous example embodiment, the body comprises a groove set into the front surface of the body, surrounding at least partly the entry of the cavity; the groove forming part of the cooling circuit.

The cooling circuit thus makes it possible not only to limit the heating of the gas target contained in the cavity but also of the window during irradiation of the gas target contained in the cavity.

For example, the inlet and the outlet of the duct emerge into the groove.

The cooling circuit is for example non-cryogenic. It for example contains a cooling liquid, for example cooling water, which flows in the circuit.

For example, the cooling circuit comprises a cooling fluid ingress, for example near the opening of the cavity.

In one example embodiment, the cooling fluid ingress comprises a pipe communicating with the duct.

For example, the cooling fluid ingress is configured to circulate the cooling fluid both in the helical portion of the duct, which surrounds the cavity configured to contain the gas to irradiate, and in the groove located facing a periphery of the window.

In another example, the cooling circuit also comprises a cooling fluid egress.

The cooling fluid egress is for example positioned beside the cooling fluid ingress.

In a preferred example embodiment, the ingress and/or the egress for cooling fluid communicate with the duct between the groove and the helical portion of the duct.

Preferably, the front surface of the body is at a right angle to a central median axis of the frusto-conical portion of the cavity and/or to an axis of propagation of the particle beam emitted by the particle accelerator.

The support flange forms a mechanical connection interface enabling both the holding of the window and the sealing of the interfaces between the cooling liquid, the ambient air, the secondary vacuum (of the particle accelerator) and the target gas (of the cavity), for example by compression of seals, for example 'O'-rings.

Seals are for example positioned between a surface of the support flange and a surface of the corresponding body.

In a particular example, the mechanical fastening interface at an exit from a particle accelerator of the support flange is configured to maintain the sealing of the vacuum of the beam line.

The mechanical fastening interface at an exit of a particle accelerator comprises for example a ring and a seal, for example an 'O'-ring seal. The ring and the seal are for example held in the support flange.

In a particularly advantageous example, the window is inserted between the body and the support flange, and for example, the support flange is secured on the body by screwing. This enables the window to be disassembled and/or reassembled easily for its replacement merely by unscrewing and/or screwing, for example with clamping screws, for example four screws, of at least part of the support flange.

For example, the front surface of the body comprises a seal, for example an "O"-ring seal, and/or the support flange comprises a seal, for example an "O"-ring seal, possibly located facing the seal of the front surface of the body.

If required, at least the thin sheet is wedged, compressed, between the body seal and the support flange seal.

This for example enables sealing to be promoted between the cooling circuit, the target gas and the vacuum at the particle accelerator side when the system is mounted on the particle accelerator.

In an example embodiment, the body comprises a passage communicating within the cavity through the back of the cavity, the passage being configured to fill the cavity with gas and empty the cavity of said gas.

In another example embodiment, the back of the cavity comprises a concave surface. The surface is for example rounded and concave.

In a particularly convenient example embodiment, the body is formed of AS7G6 aluminum alloy.

In another particularly convenient example embodiment, the body is formed by an additive manufacturing process, for example by Selective Laser Melting (SLM process).

It is thus particularly easy to incorporate the cooling circuit into a body wall, for example at least parts of the cooling fluid circulation duct the closest to the window and/or to an inside surface of the body (that is to say a wall of the cavity), and/or vary the shape of a pipe, for example between a cross-section of circular shape and a cross-section of rectangular shape, to optimize heat exchanges.

For example, the target holder system is possibly included within a maximum bulk of approximately 50×63×120 mm.

BRIEF DESCRIPTION OF THE DRAWINGS

The invention, according to an example embodiment, will be well understood and its advantages will be clearer on reading the following detailed description, given by way of illustrative example that is in no way limiting, with reference to the accompanying drawings in which.

DESCRIPTION OF THE PREFERRED EMBODIMENTS

Identical parts represented in the aforementioned figures are identified by identical numerical references.

FIGS. 1 to 4 illustrate a gas target holder system 100 according to an example embodiment of the invention.

Figure 1:
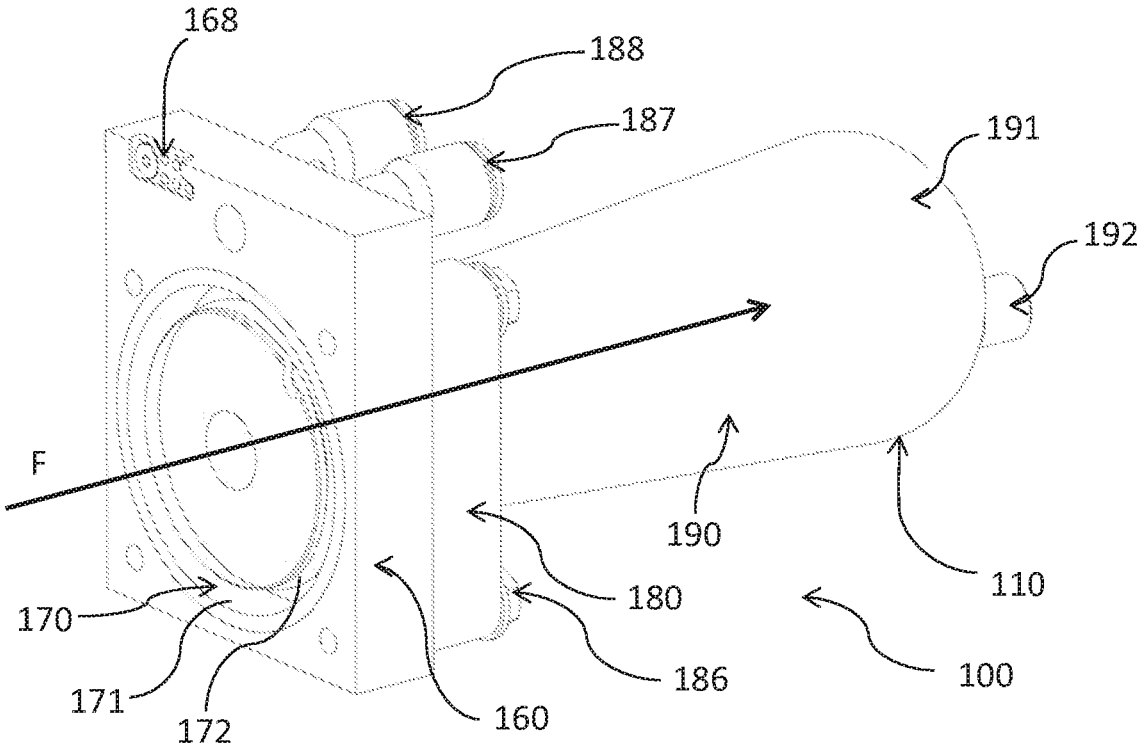
FIG. 1 shows a perspective view of a target holder system according to an example embodiment of the present invention.
Figure 2:
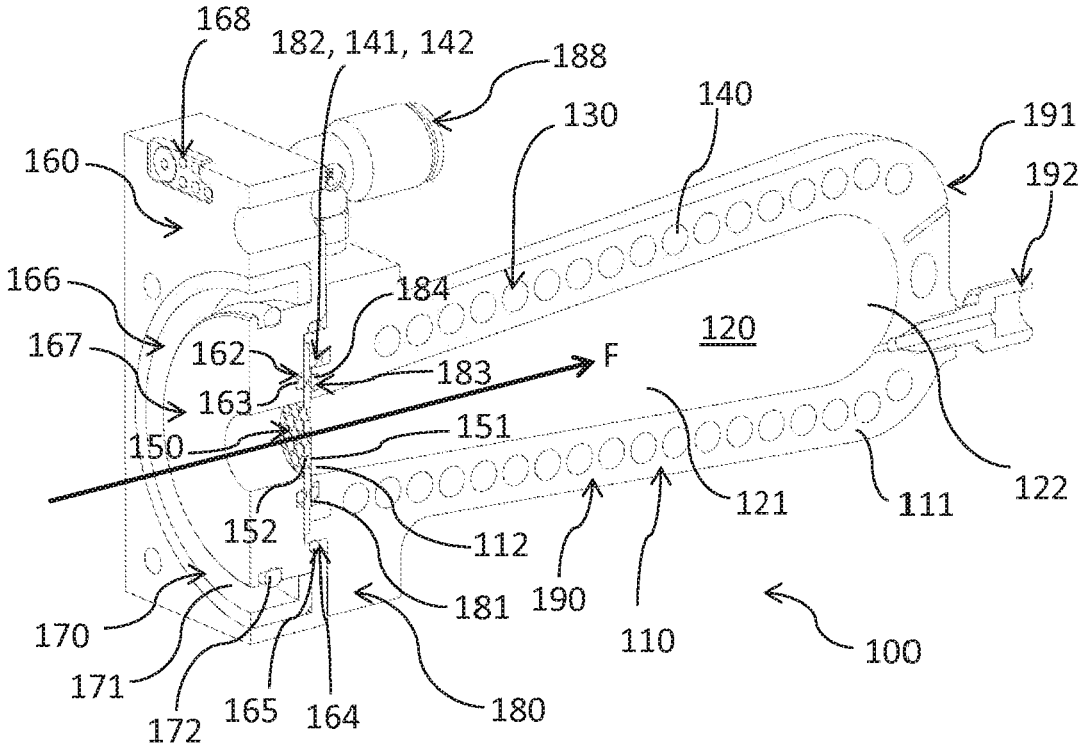
FIG. 2 is a cross-section view of the system of FIG. 1 in a vertical plan (not shown)

With reference to FIGS. 1 and 2, the gas target holder system 100 here comprises:

- a body 110, which comprises:
  - a cavity 120 configured to contain a target gas to irradiate with a particle beam F emitted by a particle accelerator (not shown), the cavity 120 comprising at least one portion 121 of frusto-conical shape, a back 122 closing a wide base of the portion 121 of frusto-conical shape and an opening 112, opposite the base 122 relative to the portion 121 of frusto-conical shape, forming an entry in order for at least part of the particle beam F to enter the cavity 120;
- a cooling circuit 130 comprising at least one duct 140 which comprises an inlet 141 and an outlet 142 and surrounds at least part of the cavity 120;
- a window 150, positioned facing the opening 112 of the cavity 120 to close the cavity, permeable to protons to enable introduction into the cavity of protons of the particle beam F emitted by the particle accelerator, the window 150 comprising a thin sheet 151, permeable to at least part of the particle beam F emitted by the particle accelerator and a support grid 152, configured to withstand pressure differences between an inside of the cavity 120 and an outside of the target holder system 100, the thin sheet 151 being positioned between the support grid 152 and the cavity 120; and
- a support flange 160 which holds the window 150 and is hermetically secured on the body 110, and which comprises a mechanical fastening interface at an exit from a particle accelerator 170; the support flange 160 being furthermore configured to hermetically close the cavity 120, for example using a specific flange 180 described below, and to at least provide sealing between air outside the target holder system and a cooling fluid flowing in the cooling circuit 130, in addition to providing sealing between a vacuum formed in a beam line of the particle accelerator and the target gas under pressure contained in the cavity 120.

Such a gas target holder system is particularly compact, as can be deduced from the drawings.

It is in particular configured for producing radioisotopes, for example $^{11}C$.

The body is for example a one-piece member.

It is for example produced from AS7G6 aluminum alloy, in particular by an additive manufacturing process, for example by Selective Laser Melting (SLM process) which makes it possible to produce simultaneously the cavity 120 which it contains as well as the cooling circuit which is advantageously formed within a wall of the body as described below.

As a matter of fact, the body 110 here comprises a wall 111.

The wall 111 delimits the cavity 120 and further comprises here, within its thickness, at least part of the cooling circuit.

In a front part, here on the left in the drawings, the body 110 comprises a flange 180 which comprises a front surface 181.

In the present example embodiment, the flange 180 comprises in particular a projection in relief which comprises the front surface 181 and a peripheral surface, delimiting a periphery of the projection, here at a right angle to the front surface 181.

Figure 3:
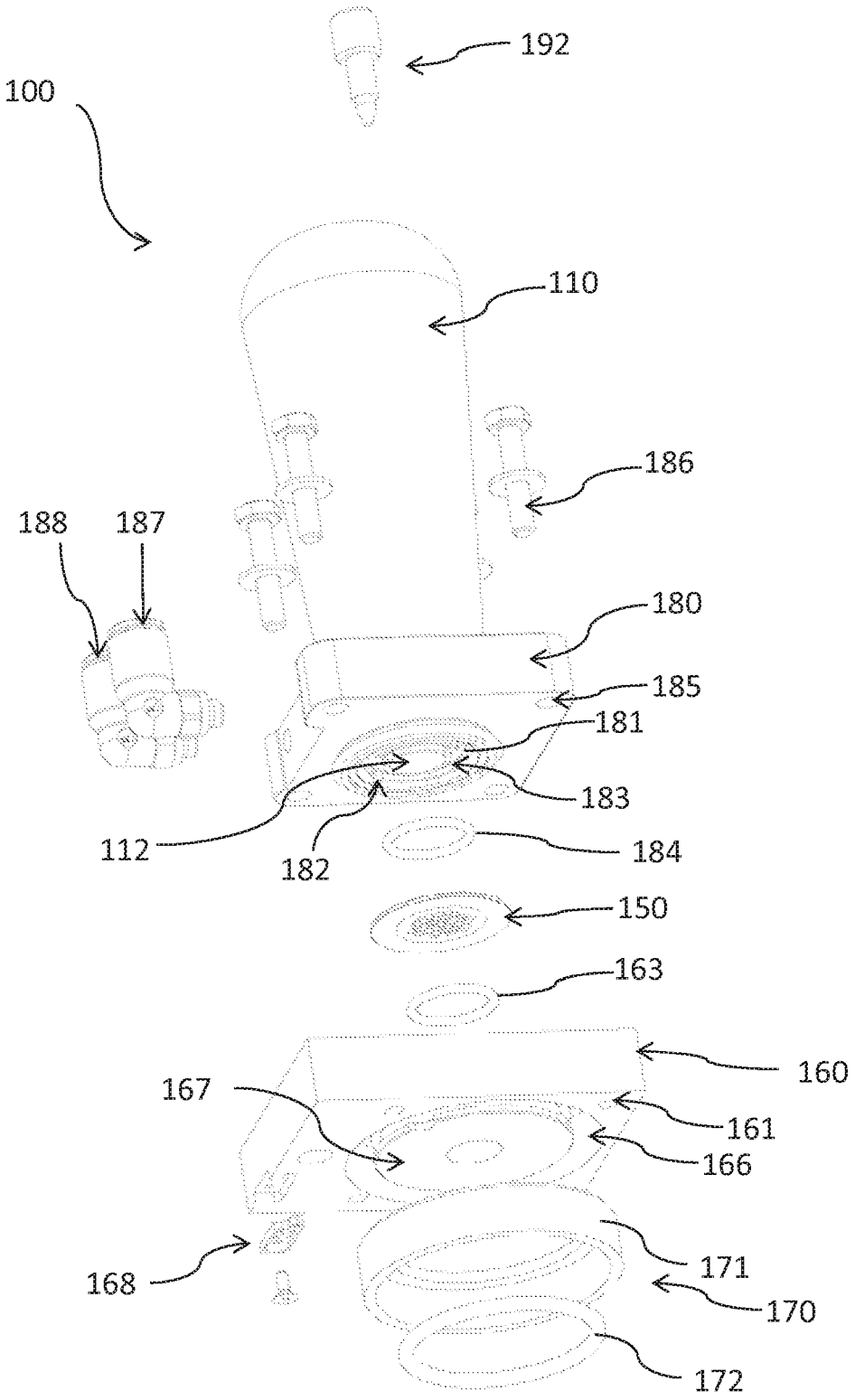
FIG. 3 is an exploded view of the system of FIGS. 1 and 2.

The flange 180 here has a cross-section that is substantially quadrilateral, or even square, as better illustrated by FIG. 3.

The flange 180 here comprises four holes 185. Each hole 185 here receives a nut and bolt 186 which enables the body 110 to be assembled to the support flange 160.

From the front surface 181, the body comprises an opening 112 from which extends the cavity 120.

Around at least part of the opening 112, and set into the front surface 181, the body 110 comprises a groove 182 which, here, constitutes part of the cooling circuit. The groove 182 however preferably is of annular shape and surrounds the opening 112.

The groove 182 thus enables cooling of the window 150 of which at least part of the thin sheet 151 is juxtaposed here, and bears, on the front surface 181, as is described later.

In the present example embodiment, the inlet 141 and the outlet 142 of the duct 140 emerge into the groove 182, which is why they are designated conjointly in FIG. 2.

Furthermore here, between the groove 182 and the opening 112, the body comprises a furrow 183, set into the front surface 181 and receiving a seal 184. The seal 184 here serves for the thin sheet 151 of the window 150 to press upon, contributing to forming a fluid-tight connection.

Lastly, the flange 180 further comprises here an ingress 187 and an egress 188 for cooling fluid for respectively bringing and extracting the cooling liquid in the cooling circuit 130.

In the example shown, the ingress 187 and the egress 188 are of course represented arbitrarily and could of course be swapped with each other.

They here comprise for example connections with corresponding hoses.

The ingress 187 and/or the egress 188 comprise for example a pipe communicating with the duct, not visible in the drawings.

In particular, the ingress 187 and the egress 188 here communicate with the duct 140, to the rear of the inlet 141 and the outlet 142 which here emerge into the groove 182 (to the "rear" being understood hear relative to introduction of the particle beam F into the cavity).

According to another example embodiment, the inlet 141 and the ingress 187 would be combined and/or the outlet 142 and the egress 188 would be combined.

Starting with the flange 180, the body 110 next comprises a main part 190 which comprises a major part of the cavity 120. The main part 190 is for example cylindrical or in particular here a frusto-conical part which comprises at least the frusto-conical portion 121 of the cavity 120.

Thus, the main frusto-conical part 190 of the body 110 flares out from the flange 180, like the cavity 120 flares out from the opening 112 of the body, which also forms the opening 112, the entry, of the cavity 120.

The opening 112, of circular shape, thus has a smaller diameter than that of any circular section of the frusto-conical portion 121 of the cavity.

A particle beam F can thus be introduced through the opening 112 into the cavity 120 to irradiate the gas that it contains in use.

Lastly, the body is closed by a back 191 which comprises the back 122 of the cavity 120.

The back 122 of the cavity 120 is for example a rounded concave surface, for example in the form of a dome.

Starting from the opening 112, the cavity thus has the shape of a teardrop. It comprises a section widening from the opening 112 to the back 122 (where the section narrows on account of its rounded shape).

The back 191 of the body 110 further comprises a specific passage, which passes through the wall of the body and opens into the cavity 120. The gas target holder system 100 comprises a connection tip 192, for example a conventional 1/16" connector, inserted into this specific passage and enabling the cavity 120 to be filled or emptied with the target gas.

As mentioned earlier, the cavity 120 is formed within the body 110, and is surrounded by the wall 111.

In the wall 111 of the body 110, mainly in the part of the wall 111 which surrounds the cavity 120, the body 110 here comprises the duct 140 of the cooling circuit 130.

The duct 140 here has a portion of helical shape, starting from the flange 180 of the body then extending towards the rear of the body to reach the back 191 of the body, to return to the front of the body, here also at the flange 180. The duct 140 continues between the helical portion to reach the inlet 141 and outlet 142 which here emerge into the groove 182 of the flange 180 of the body 110.

The duct 140 is here supplied via the ingress 187 and egress 188 of cooling fluid which communicate with the duct between the inlet 141 and outlet 142 of the duct 140 at the front surface 181 of the body and with the helical portion of the duct 140.

Thus, the duct 140 surrounds the cavity 120 and is positioned as close as possible to the parts heated by an interaction of the particle beam F with the gas contained in the cavity 120, including in particular the surface of the cavity (that is to say an inside surface of the body) and the window 150.

As mentioned earlier, the gas target holder system 100 also comprises the window 150 which comprises the thin sheet 151 and the support grid 152.

The window enables both the passage of the protons towards the cavity and hermetically closes the latter with the aid of the support flange 160 described below.

To facilitate positioning of the window 150, the front surface 181 possibly comprises a hollow indentation into which the window 150 is possibly deposited.

Preferably the window is held onto the body 110 using the support flange 160, described below, promoting bearing by the window on the front surface 181 of the body and making it possible to ensure the sealing of air/secondary vacuum/cooling fluid/target gas via the use of seals at the interfaces.

The support grid 152 enables the thin sheet 151 to be supported so as to withstand pressure differences between the incident part of the beam F under secondary vacuum (on the support grid side) and the cavity (thin sheet side) under gas pressure comprised for example between 20 and 50 bars when the system 120 is used.

The thin sheet 151 is positioned between the support grid 152 and the front surface 181 of the body 110. The thin sheet 151 here covers at least part of the front surface 181, and in particular at least the groove 182 which surrounds at least in part the opening 112 of the cavity 120, to be able to be cooled by the same cooling circuit 130 as that which cools the cavity 120.

Thus, here, the thin sheet covers both the opening 112 and the groove 182 and bears on the seal 184 located between the opening 112 and the groove 182.

The support grid 152 is for example of tungsten or of aluminum nitride and for example is of thickness comprised between approximately 1 mm and approximately 3 mm.

The support grid 152 for example has perforations of circular or hexagonal shape.

The thin sheet 151 is of small thickness, that is to say that it is of thickness equal to or less than 100 μm.

For example, for a thin sheet of tungsten, it is for example of thickness comprised between approximately 20 μm and approximately 30 μm; while for a thin sheet of CVD synthetic diamond, it is for example of thickness comprised between approximately 70 μm and approximately 80 μm.

Lastly, the gas target holder system 100 comprises the support flange 160.

The support flange 160 is for example a solid member which here has a cross-section that is substantially quadrilateral, in particular square.

It comprises here holes 161 opposite holes 185 of the flange 180 to receive nuts and bolts 186 which contribute to clamped fastening of the support flange 160 to the flange 180 of the body.

The support flange 160 comprises a furrow 162, set into a rear surface of the support flange 160, and receiving a seal 163.

In the present example embodiment, the seal 163 of the support flange 160 thus faces the seal 184 of the body 110. Thus, the window 150 is pinched, confined, between the seal 163 of the support flange 160 and the seal 184 of the body 110.

To further secure sealing of the cooling circuit, the support flange 160 also comprises a furrow 164 which receives a seal 165.

The furrow 164 is here set into a peripheral wall, here at a right angle to the back surface of the support flange 160 which is formed set into the support flange 160. Thus, the seal 165 surrounds the back surface of the support flange 160.

The peripheral wall of the support flange 160 thus cooperates with the peripheral surface of the projection in relief of the flange 180 of the body 110.

The seal 165 is positioned here between the peripheral wall of the back surface of the support flange 160 and the peripheral surface of the projection in relief of the flange 180 of the body 110.

It is thus also possible to consider that the seal 165 surrounds, fits tightly around, the projection in relief of the flange 180 of the body 110.

The seals 163 and 165 of the support flange 160 are thus disposed on opposite sides of the groove 182 of the flange 180 of the body.

The support flange 160 is thus configured to hermetically close the cavity 120, for example in cooperation with the flange 180 of the body 110, and to at least provide sealing between air outside the target holder system and a cooling fluid flowing in the cooling circuit 130, in addition to providing sealing between a vacuum formed in a beam line of the particle accelerator and the target gas under pressure contained in the cavity 120 when the system 100 is used.

Lastly, the support flange 160 comprises a mechanical fastening interface at an exit from a particle accelerator 170.

In the present example embodiment, the mechanical fastening interface at an exit from a particle accelerator 170 here comprises at least one ring 171 and an 'O'-ring seal 172.

In particular, the ring 171 and the 'O'-ring seal 172 are here embedded in the support flange 160.

To that end, the support flange 160 comprises, at its front face, a groove 166 which delimits a central projection 167.

The ring 171 is sunk into the groove 166 and the 'O'-ring seal 172 fits tightly around the central projection 167.

Lastly, the support flange 160 comprises for example an electronic target-identification coding center 168 which is for example an electronic component configured to identify the target.

The electronic target-identification coding center 168 is inserted here in an accommodation provided for that purpose in a corner of the front face of the support flange 160 and is for example fastened thereto by a removable fastener, for example such as a screw.

Figure 4:
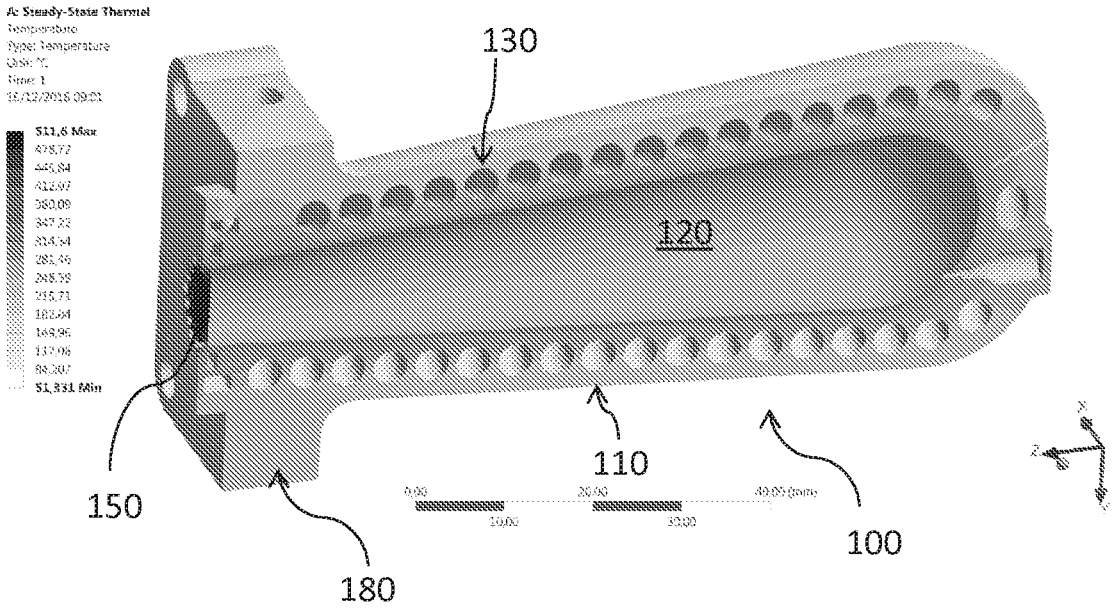
FIG. 4 shows an example of a temperature field (heating of the target holder) in degrees Celsius (° C.) obtained by digital simulation for an example of implementation of the system of FIGS. 1 to 3.

FIG. 4 enables it to be observed that in use, the gas target holder system 100 described above has maximum heating at the location of the window 150 which is less than 515° C., for example particularly of the order of 478-512° C., while the outside surface, the shell, of the system 100, remains at a temperature less than approximately 85° C., in particular comprised between approximately 51° C. and approximately 84° C. As regards a surface of the cavity 120, this is kept at a temperature less than approximately 249° C., or less even than approximately 200° C. by the cooling system.

The invention claimed is:

1. A gas target holder system (100) comprising:

a body (110), which comprises:

a cavity (120) configured to contain a target gas to irradiate with a particle beam (F) emitted by a particle accelerator, the cavity (120) comprising at least one portion (121) of frusto-conical shape, a back (122) closing a wide base of the portion of frusto-conical shape and an opening (112), opposite the back relative to the portion of frusto-conical shape, forming an entry in order for at least part of the particle beam to enter the cavity;

a window (150), positioned facing the entry of the cavity to close the cavity, permeable to protons to enable introduction into the cavity of protons of the particle beam (F) emitted by the particle accelerator, the window comprising a sheet (151) permeable to at least part of the particle beam emitted by the particle accelerator and a support grid (152) configured to withstand pressure differences between an inside of the cavity and an outside of the target holder system, the sheet (151) being positioned between the support grid (152) and the cavity (120);

a support flange (160) which holds the window (150) and is hermetically secured on the body (110), and which comprises a mechanical fastening interface at an exit from a particle accelerator (170); the support flange (160) being furthermore configured to hermetically close the cavity (120) and to at least provide sealing between air outside the target holder system and a cooling fluid flowing in the cooling circuit (130), in addition to providing sealing between a vacuum formed in a beam line of the particle accelerator and a target gas under pressure contained in the cavity (120); and a cooling circuit comprising an inlet, a groove in a front surface of the body which faces the support flange, the groove at least partly surrounding the entry of the cavity, and a duct comprising a first helical portion formed in a wall of the body surrounding the cavity and extending from the inlet to the back of the cavity and a second helical portion formed in a wall of the body surrounding the cavity and extending from the back of the cavity to the outlet, wherein coolant circulates from the inlet, into the groove, then the first helical portion and returns to the outlet through the second helical portion and the groove.

2. A system (100) according to claim 1, wherein the support grid (152) has an open/filled area ratio comprised between approximately 70% and approximately 90%.

3. A system (100) according to claim 1, wherein the support grid (152) is of tungsten or of aluminum nitride.

4. A system (100) according to claim 1, wherein the support grid (152) is of thickness comprised between approximately 1 mm and approximately 3 mm.

5. A system (100) according to claim 1, wherein the thin sheet (151) is of thickness equal to or less than 100 μm.

6. A system (100) according to claim 1, wherein the sheet (151) is of tungsten or of synthetic diamond.

7. A system (100) according to claim 1, wherein the front surface (181) forms a bearing surface for at least part of the sheet (151) of the window (150).

8. A system (100) according to claim 7, wherein both the inlet (141) and outlet (142) of the duct (140) emerge into the front surface (181) of the body (110).

9. A system (100) according to claim 1, wherein the window (150) is inserted between the body (110) and the support flange (160).

10. A system (100) according to claim 1, wherein the back (122) of the cavity comprises a concave surface.

11. A system (100) according to claim 1, wherein the body is formed of aluminum alloy and/or by an additive manufacturing process.

12. A system (100) according to claim 1, wherein the sheet (151) is of thickness equal to or less than 80 μm.

13. A system (100) according to claim 1, wherein the sheet (151) is of thickness equal to or less than 30 μm.

14. A system (100) according to claim 1, wherein the sheet (151) is of thickness equal to or less than 20 μm.

15. A system (100) according to claim 1, wherein the cooling circuit (130) comprises a cooling fluid ingress (187), which is configured to introduce the cooling fluid to the cooling circuit.

16. A gas target holder system (100) comprising:

a body (110), which comprises:

a cavity (120) configured to contain a target gas to irradiate with a particle beam (F) emitted by a particle accelerator, the cavity (120) comprising at least one portion (121) of frusto-conical shape, a back (122) closing a wide base of the portion of frusto-conical shape and an opening (112), opposite the back relative to the portion of frusto-conical shape, forming an entry in order for at least part of the particle beam to enter the cavity;

a cooling circuit (130) comprising at least one duct (140) which comprises an inlet (141) and an outlet (142) and surrounds at least part of the cavity (120);

a window (150), positioned facing the entry of the cavity to close the cavity, permeable to protons to enable introduction into the cavity of protons of the particle beam (F) emitted by the particle accelerator, the window comprising a sheet (151) permeable to at least part of the particle beam emitted by the particle accelerator and a support grid (152) configured to withstand pressure differences between an inside of the cavity and an outside of the target holder system, the sheet (151) being positioned between the support grid (152) and the cavity (120); and a support flange (160) which holds the window (150) and is hermetically secured on the body (110), and which comprises a mechanical fastening interface at an exit from a particle accelerator (170); the support flange (160) being furthermore configured to hermetically close the cavity (120) and to at least provide sealing between air outside the target holder system and a cooling fluid flowing in the cooling circuit (130), in addition to providing sealing between a vacuum formed in a beam line of the particle accelerator and a target gas under pressure contained in the cavity (120), wherein the body (110) comprises a front surface (181) which forms a bearing surface for at least part of the sheet (151) of the window (150), and wherein the body (110) comprises a groove (182), set into the front surface (181), surrounding at least partly the entry of the cavity, the groove (182) forming part of the cooling circuit (130).

17. A system (100) according to claim 16, wherein the cooling circuit duct (140) is formed in a body wall (111).

18. A system (100) according to claim 17, wherein the cooling circuit duct (140) comprises at least one helical portion which surrounds at least part of the cavity (120).

19. A system (100) according to claim 17, wherein the support grid (152) has an open/filled area ratio comprised between approximately 70% and approximately 90%.

* * * * *